US010312624B1

(12) United States Patent
Baza

(10) Patent No.: US 10,312,624 B1
(45) Date of Patent: Jun. 4, 2019

(54) CONNECTOR WITH PRIMARY LOCK REINFORCEMENT

(71) Applicant: Delphi Technologies, LLC, Troy, MI (US)

(72) Inventor: Darien Aguilar Baza, Saltillo (MX)

(73) Assignee: Delphi Technologies, LLC, Troy, MI (US)

( * ) Notice: Subject to any disclaimer, the term of this patent is extended or adjusted under 35 U.S.C. 154(b) by 0 days.

(21) Appl. No.: 15/957,992

(22) Filed: Apr. 20, 2018

(51) Int. Cl.

| | |
|---|---|
| ***H01R 13/514*** | (2006.01) |
| ***H01R 13/436*** | (2006.01) |
| ***H01R 13/422*** | (2006.01) |
| ***H01R 13/62*** | (2006.01) |
| ***H01R 13/50*** | (2006.01) |
| ***H01R 13/428*** | (2006.01) |

(52) U.S. Cl.
CPC ..... *H01R 13/4361* (2013.01); *H01R 13/422* (2013.01); *H01R 13/428* (2013.01); *H01R 13/50* (2013.01); *H01R 13/62* (2013.01)

(58) Field of Classification Search
CPC ..... H01R 13/62; H01R 13/50; H01R 13/422; H01R 13/428; H01R 13/4361
USPC ..... 439/752
See application file for complete search history.

(56) References Cited

U.S. PATENT DOCUMENTS 3,516,087 A * 6/1970 Rueger ..... H01R 13/422 340/815.51
3,521,218 A * 7/1970 Carissimi ..... H01R 13/62 24/DIG. 53
4,557,542 A * 12/1985 Coller ..... H01R 13/4364 439/595
4,820,198 A * 4/1989 Lulko ..... H01R 13/4364 439/595
4,969,841 A * 11/1990 Sueyoshi ..... H01R 13/422 439/595
5,069,639 A * 12/1991 Kodama ..... H01R 13/4365 439/594
5,160,279 A * 11/1992 Sagawa ..... H01R 13/422 439/595

(Continued)

*Primary Examiner* — Abdullah A Riyami
*Assistant Examiner* — Vladimir Imas
(74) *Attorney, Agent, or Firm* — Joseph V Bonadies

(57) ABSTRACT

An electrical connector includes an electrical-terminal, a connector-housing, and a primary-lock-reinforcement. The electrical-terminal is configured to receive a corresponding electrical-terminal. The connector-housing defines a first-aperture, a second-aperture, and a body. The connector-housing is configured to receive the electrical-terminal through the first-aperture along a longitudinal-axis of the connector-housing. The body defines a cavity having a cantilevered terminal-lock. The cantilevered terminal-lock terminates proximate an outer-wall of the body. The cantilevered terminal-lock is configured to releasably retain the electrical-terminal. The outer-wall defines an orifice positioned proximate a terminus of the cantilevered terminal-lock. The primary-lock-reinforcement is configured to support the terminus of the cantilevered terminal-lock. When the primary-lock-reinforcement is moved from a pre-stage-position to a seated-position the terminus is inhibited from deflecting away from the electrical-terminal along a mating-axis thereby sealing the orifice.

20 Claims, 8 Drawing Sheets

(56) References Cited

U.S. PATENT DOCUMENTS

| | | | | | |
|---|---|---|---|---|---|
| 5,509,828 | A * | 4/1996 | Muta | H01R 13/4361 | 439/699.2 |
| 5,520,553 | A * | 5/1996 | Cecil, Jr. | H01R 13/4365 | 439/595 |
| 5,537,501 | A * | 7/1996 | Iwano | G02B 6/3817 | 385/56 |
| 5,673,346 | A * | 9/1997 | Iwano | G02B 6/3817 | 385/60 |
| 6,083,033 | A * | 7/2000 | Yamamoto | H01R 13/113 | 439/381 |
| 8,939,779 | B1 * | 1/2015 | Lindblom | H01R 13/625 | 439/121 |
| 9,653,859 | B1 * | 5/2017 | Moore | H01R 11/07 | |
| 9,780,487 | B1 * | 10/2017 | Campbell | H01R 13/62916 | |
| 9,979,121 | B2 * | 5/2018 | Reimann | H01R 13/4361 | |
| 10,122,113 | B1 * | 11/2018 | Bonucci | H01R 13/428 | |
| 2013/0023163 | A1 * | 1/2013 | Glick | H01R 13/422 | 439/752 |

* cited by examiner

CONNECTOR WITH PRIMARY LOCK REINFORCEMENT

TECHNICAL FIELD OF INVENTION

This disclosure generally relates to an electrical connector, and more particularly relates to an electrical connector with a compressible primary lock reinforcement.

BRIEF DESCRIPTION OF DRAWINGS

The present invention will now be described, by way of example with reference to the accompanying drawings, in which.

DETAILED DESCRIPTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
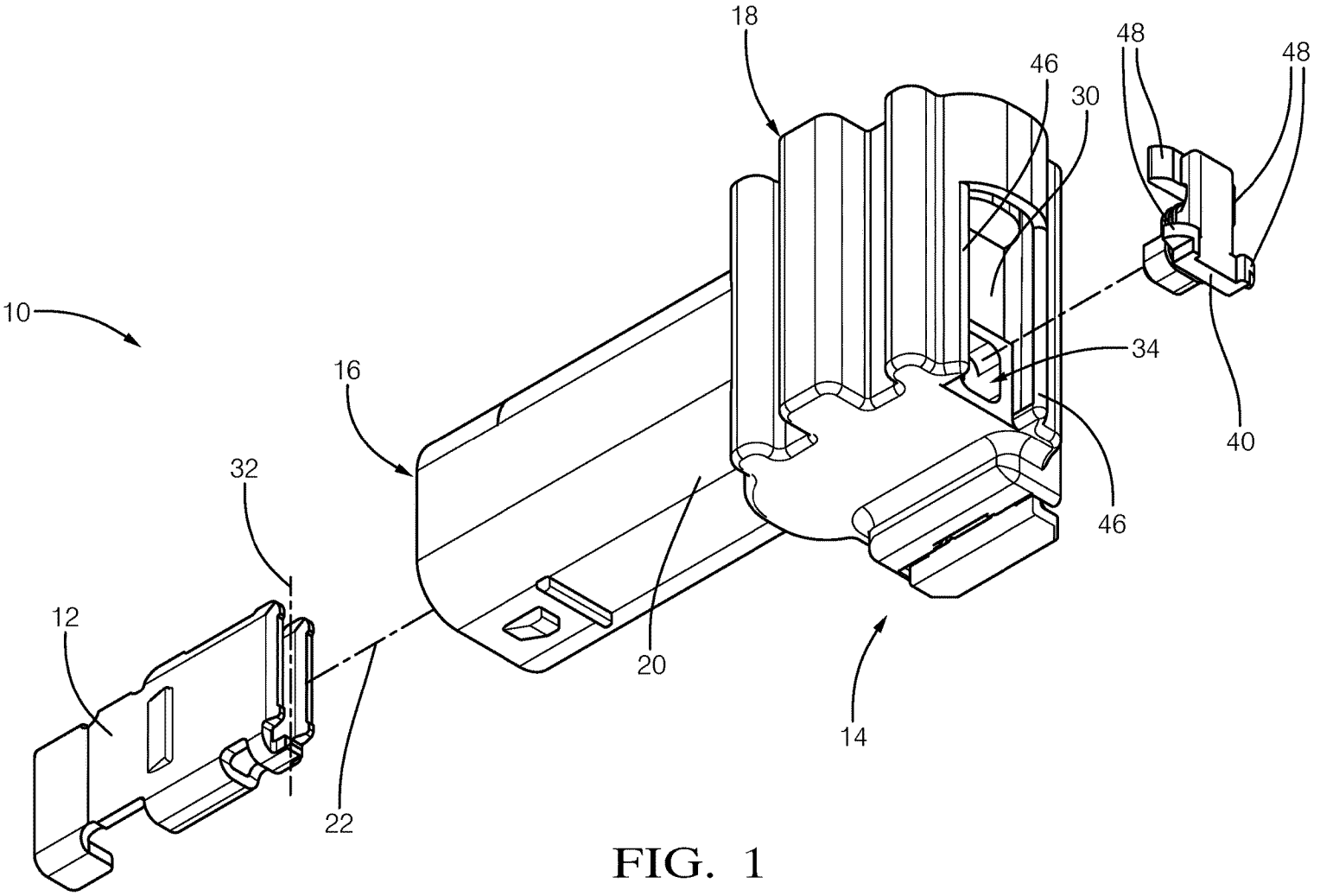
FIG. 1 is an exploded-view of an electrical connector assembly in accordance with one embodiment.

FIG. 1 illustrates an exploded view of an electrical connector assembly 10, hereafter referred to as the assembly 10. The assembly 10 includes an electrical-terminal 12 configured to receive a corresponding electrical-terminal (not shown). The electrical-terminal 12 is formed of an electrically conductive material, such as a copper-based alloy that may also include a coating of another conductive material (e.g. tin-based, silver-based coating). The electrical-terminal 12 is configured to be attached to a wire cable (not shown) that may be a component of a wiring-harness of a vehicle.

The assembly 10 also includes a connector-housing 14 formed of a polymeric dielectric material. The dielectric material may be any dielectric material capable of electrically isolating portions of the electrical-terminal 12, and is preferably a polyamide (NYLON) material. The connector-housing 14 defines a first-aperture 16, a second-aperture 18, and a body 20. The connector-housing 14 is configured to receive the electrical-terminal 12 through the first-aperture 16 along a longitudinal-axis 22 of the connector-housing 14.

Figure 2:
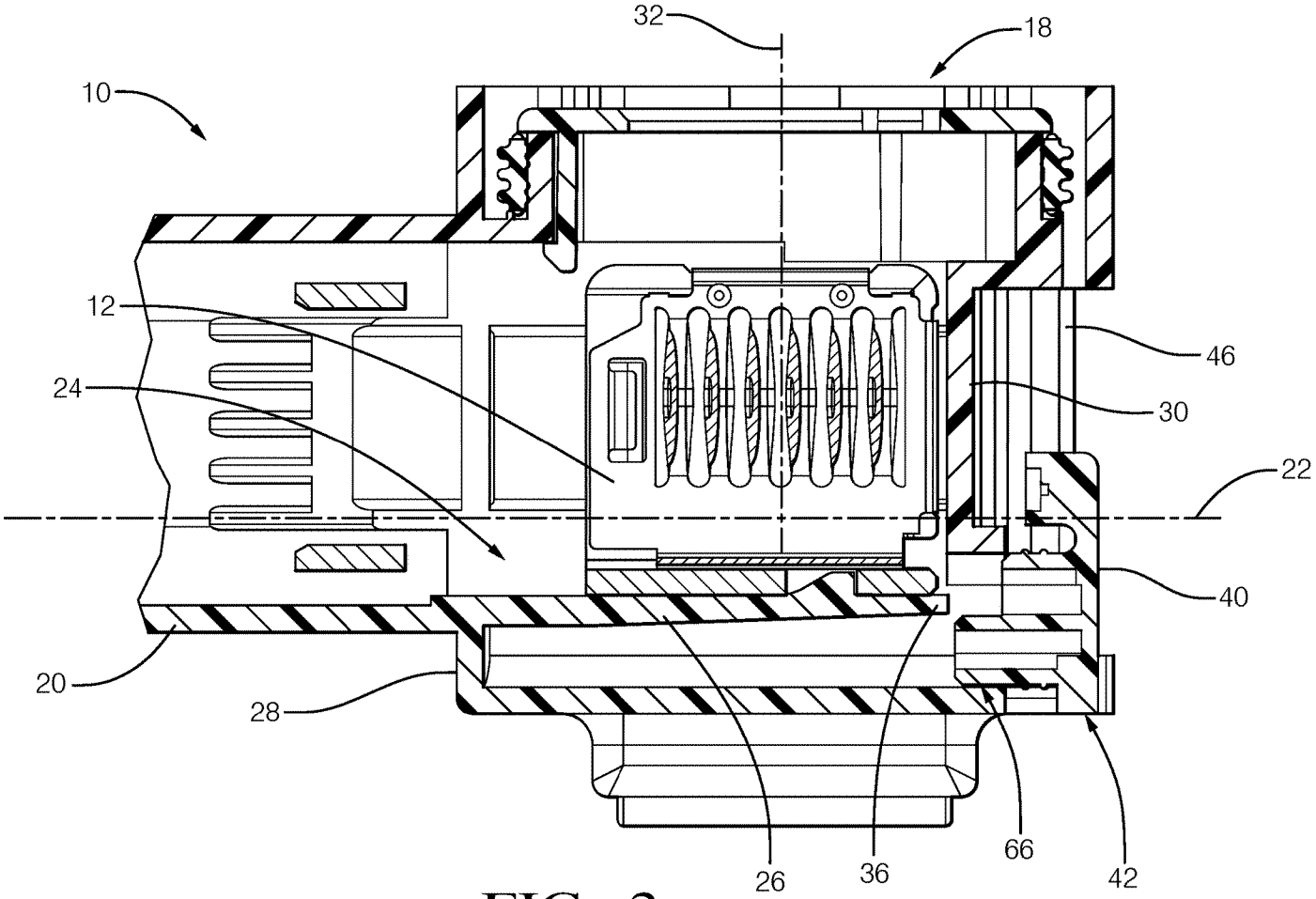
FIG. 2 is a section-view of the electrical connector assembly of FIG. 1 in accordance with one embodiment.

FIG. 2 is a section-view of the assembly 10 illustrating the electrical-terminal 12 in an installed-position. The body 20 defines a cavity 24 having a cantilevered terminal-lock 26 disposed within and attached to a base 28 of the body 20. The cantilevered terminal-lock 26 is preferably formed integral to the body 20, as illustrated in FIG. 2. The cantilevered terminal-lock 26 extends along the longitudinal-axis 22 and terminates proximate (i.e. just short of) an outer-wall 30 of the body 20. As used herein, the term "proximate" includes distances between components of less than 10.0 mm. The cantilevered terminal-lock 26 is configured to releasably retain the electrical-terminal 12 such that the electrical-terminal 12 is positioned to receive the corresponding electrical-terminal 12 through the second-aperture 18 along a mating-axis 32 of the electrical-terminal 12. As illustrated in FIG. 2, the cantilevered terminal-lock 26 includes a ramped protrusion with a face that engages a notch in the electrical-terminal 12. The ramp interacts with the electrical-terminal 12 to deflect the cantilevered terminal-lock 26 along the mating-axis 32 while the electrical-terminal 12 is being inserted into the cavity 24 until the ramped protrusion is disposed into the notch.

Figure 3:
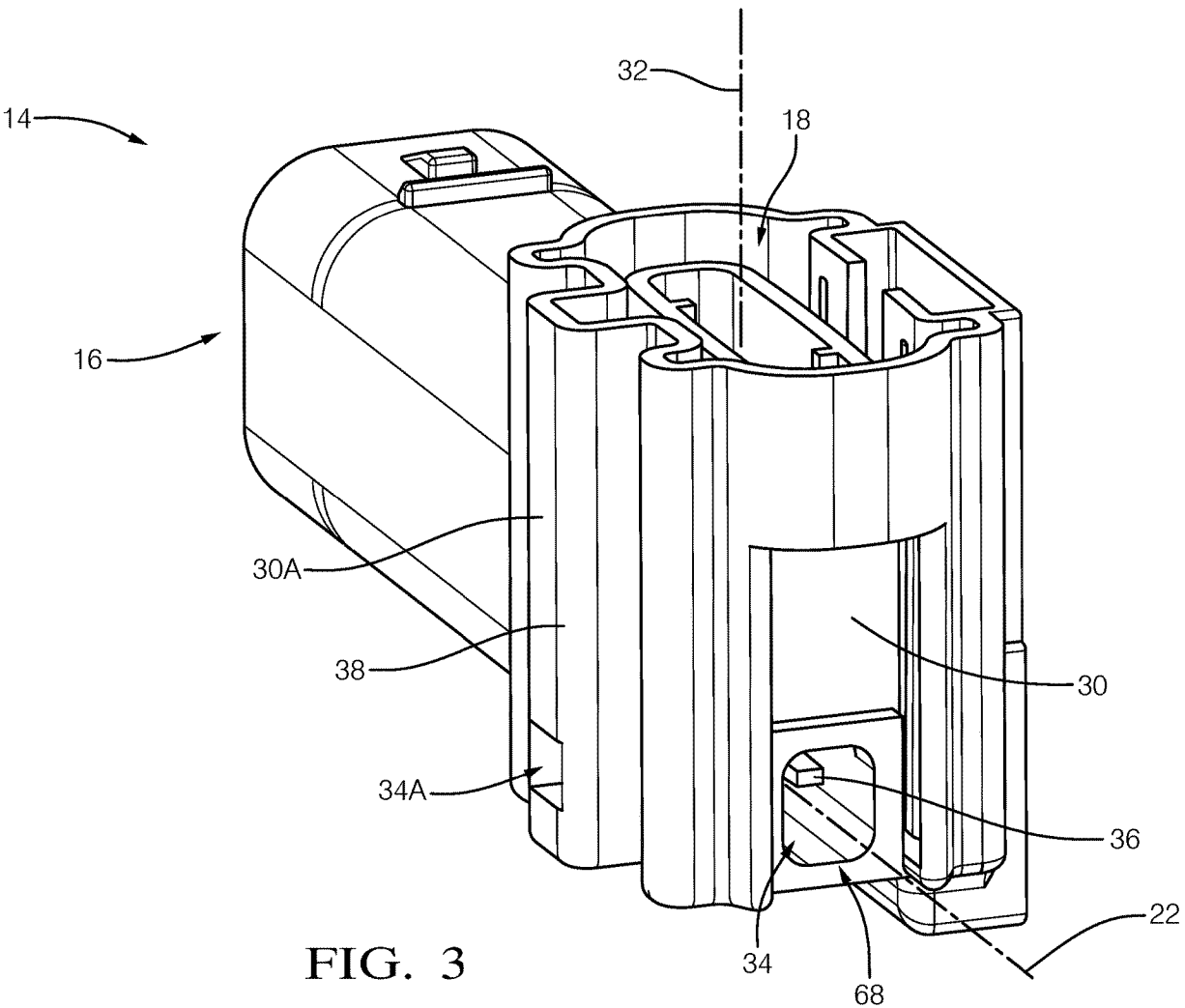
FIG. 3 is a perspective-view of a connector-housing of the electrical connector assembly of FIG. 1 in accordance with one embodiment.

FIG. 3 is a perspective-view of the connector-housing 14 showing the second-aperture 18 in the foreground. The outer-wall 30 defines an orifice 34 positioned proximate a terminus 36 of the cantilevered terminal-lock 26. As illustrated in FIGS. 1-3, the mating-axis 32 of the electrical-terminal 12 is orthogonal to the longitudinal-axis 22. That is, the assembly 10 is characterized as having a 90-degree angle between the planes that include the first-aperture 16 and the second-aperture 18. The outer-wall 30 is opposite the first-aperture 16 and adjacent the second-aperture 18, and is aligned orthogonal to the longitudinal-axis 22. In other words, the orifice 34 is formed in an end of connector-housing 14 so that cantilevered terminal-lock 26 may be molded into connector-housing 14. This placement of the orifice 34 has the technical benefit of enabling a single injection molding tool to form the connector-housing 14, which would not otherwise be possible due to 90-degree configuration. In addition, an inner-connector that would typically be required to retain the electrical-terminal 12 within the connector-housing 14 is eliminated. In another embodiment not specifically shown, the mating-axis 32 of the electrical-terminal 12 is also orthogonal to the longitudinal-axis 22, and an outer-wall 30A is adjacent both the first-aperture 16 and the second-aperture 18, and aligned parallel to the longitudinal-axis 22. An orifice 34A is formed in a side 38 of connector-housing 14 as an option to being formed into the end of the connector-housing 14.

Referring back to FIG. 1, the assembly 10 also includes a primary-lock-reinforcement 40 (PLR 40) configured to support the terminus 36 of the cantilevered terminal-lock 26 when the PLR 40 is moved from a pre-stage-position 42 to a seated-position 44, as will be described in more detail below. The connector-housing 14 includes a pair of opposed arcuate flexible-beams 46 that extend beyond the outer-wall 30 along the longitudinal-axis 22. The PLR 40 includes retention-features 48 projecting from an outer-surface orthogonal to the longitudinal-axis 22.

Referring back to FIG. 2, the retention-features 48 are configured to releasably retain the PLR 40 between the pair of opposed arcuate flexible-beams 46 in the pre-stage-position 42. In the pre-stage-position 42, the PLR 40 is attached to the connector-housing 14 but is not supporting the terminus 36 of the cantilevered terminal-lock 26, which enables the insertion of the electrical-terminal 12 into the cavity 24. The pre-stage-position 42 is advantageous to reduce an incidence of loss of the PLR 40 during shipping and handling of the assembly 10.

Figure 4:
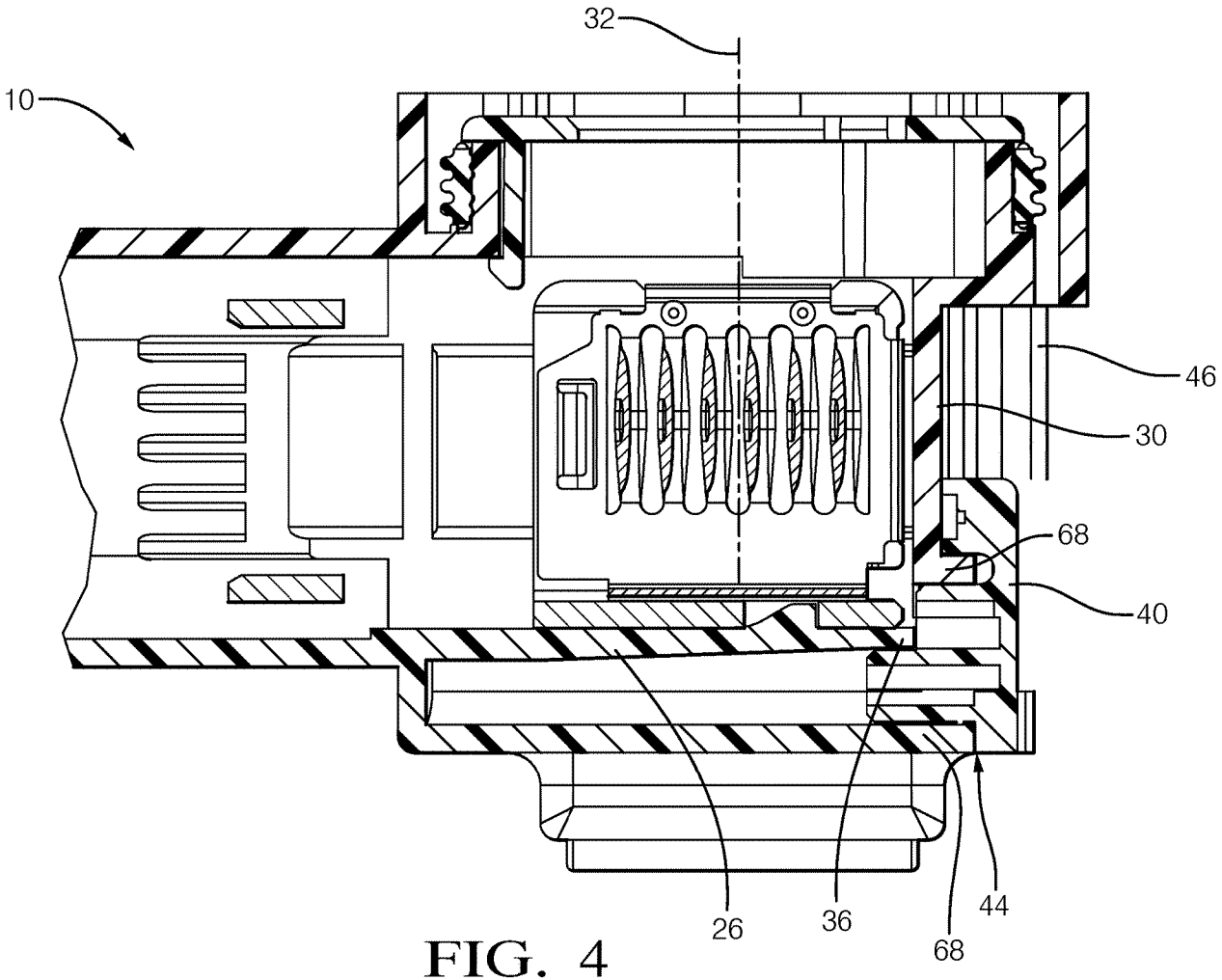
FIG. 4 is another section-view of the electrical connector assembly of FIG. 1 in accordance with one embodiment.

FIG. 4 is the section-view of the assembly 10 of FIG. 2 with the PLR 40 in the seated-position 44. When the PLR 40 is moved from the pre-stage-position 42 (see FIG. 2) to the seated-position 44, the terminus 36 is supported by the PLR 40 and is inhibited from deflecting away from the electrical-terminal 12 along the mating-axis 32, thereby sealing the orifice 34.

Figure 5A:
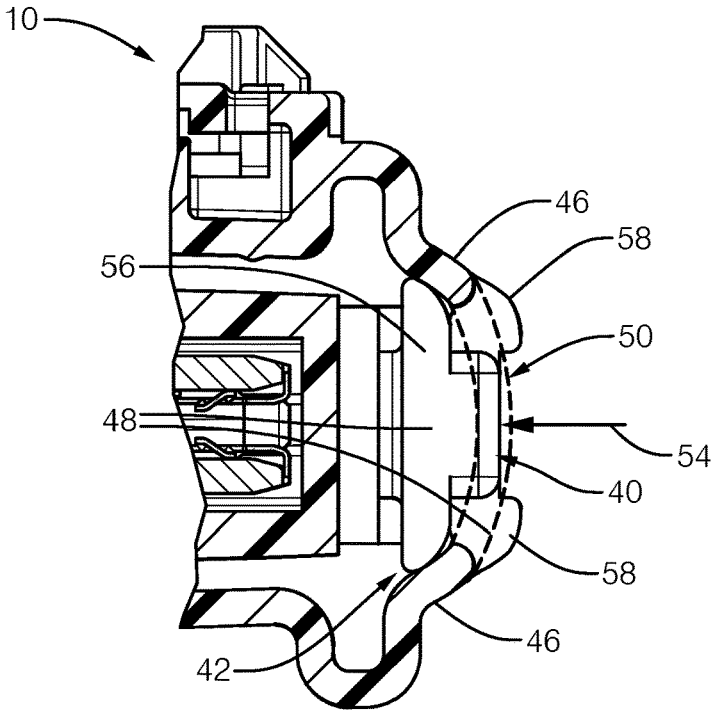
FIG. 5A is yet another section-view of the electrical connector assembly of FIG. 1 in accordance with one embodiment.
Figure 5B:
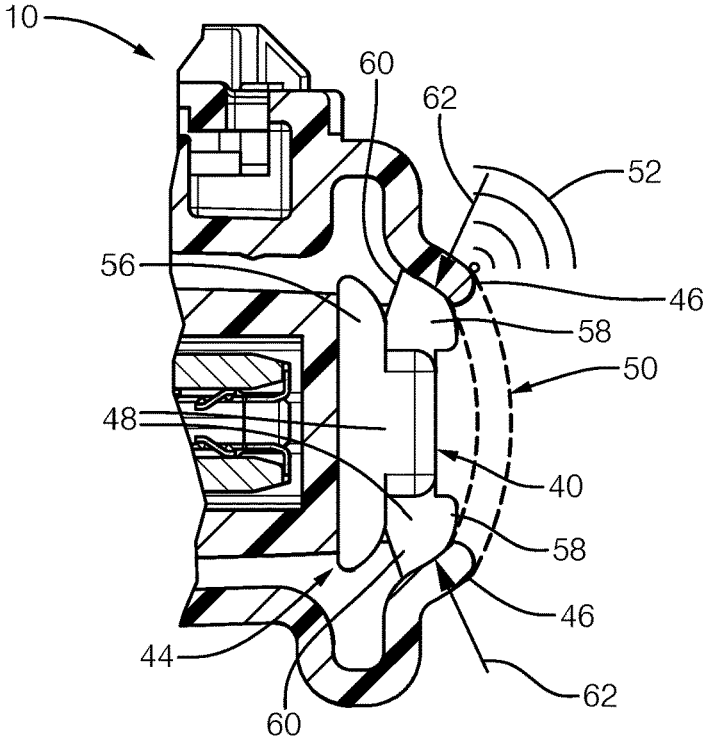
FIG. 5B is yet another section-view of the electrical connector assembly of FIG. 1 in accordance with one embodiment.
Figure 6A:
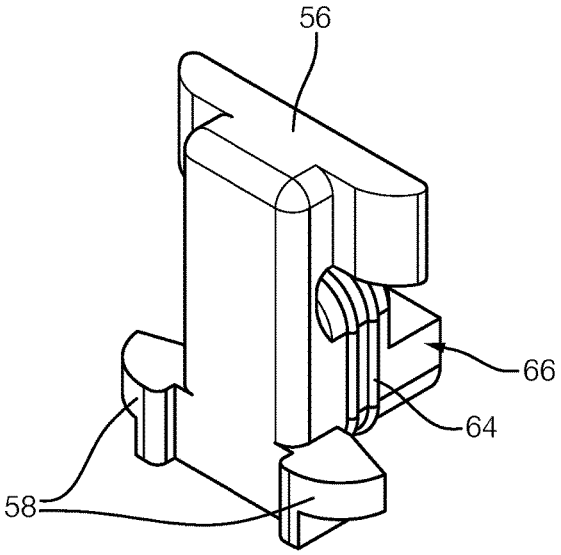
FIG. 6A is a perspective-view of a primary-lock-reinforcement of the electrical connector assembly of FIG. 1 in accordance with one embodiment.
Figure 6B:
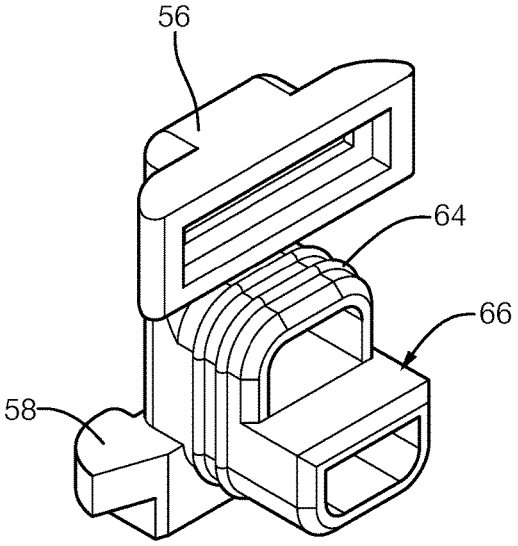
FIG. 6B is another perspective-view of the primary-lock-reinforcement of FIG. 6A in accordance with one embodiment.
Figure 6C:
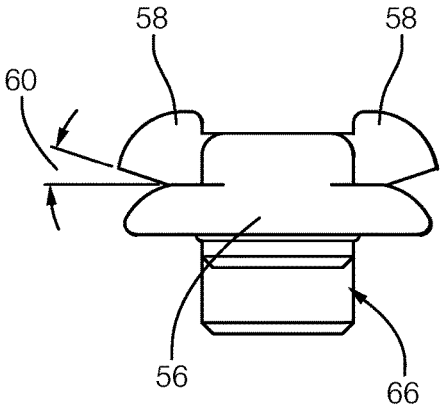
FIG. 6C is a top-view of the primary-lock-reinforcement of FIG. 6A in accordance with one embodiment.
Figure 6D:
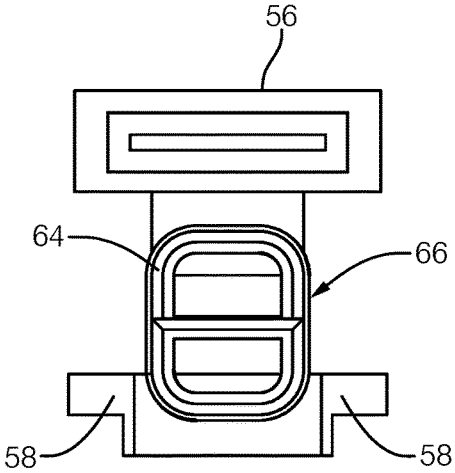
FIG. 6D is an end-view of the primary-lock-reinforcement of FIG. 6A in accordance with one embodiment.
Figure 6E:
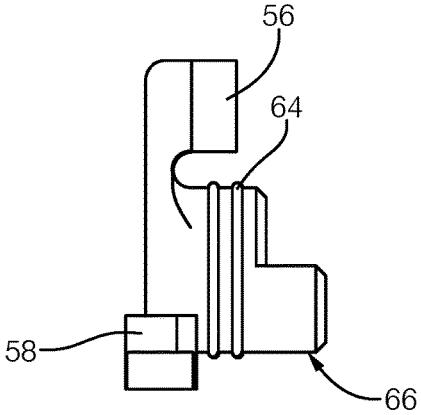
FIG. 6E is a side-view of the primary-lock-reinforcement of FIG. 6A in accordance with one embodiment.
Figure 6F:
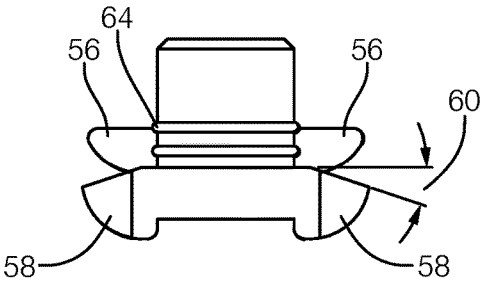
FIG. 6F is a bottom-view of the primary-lock-reinforcement of FIG. 6A in accordance with one embodiment.

FIGS. 5A-5B are section-views along the mating-axis 32 of a portion of the assembly 10 and illustrate the PLR 40 in the pre-stage-position 42 and the seated-position 44, respectively. When the PLR 40 is moved from the pre-stage-position 42 to the seated-position 44 the retention-features 48 are disposed within an arc 50 defined by the pair of opposed arcuate flexible-beams 46. The retention-features 48 may be configured to produce a vibratory-response 52 when the PLR 40 is moved from the pre-stage-position 42 to the seated-position 44 as illustrated in FIG. 5B. The vibratory-response 52 may provide an assembler a tactile indication that the PLR 40 is in the seated-position 44 in addition to a visual indication. The PLR 40 is configured to provide an engagement-force 54 of at least 10 Newtons to move the PLR 40 from the pre-stage-position 42 to the seated-position 44. The inventor has discovered that the engagement-force 54 of at least 10 Newtons provides a sufficient resistance to inhibit the PLR 40 from being inadvertently moved to the seated-position 44.

FIGS. 6A-6F illustrate several views of the PLR 40 isolated from the assembly 10 and show the retention-features 48 in greater detail. The retention-features 48 define a first-pair of opposed arms 56 extending from the outer-surface located in a first-plane, and further define a second-pair of opposed arms 58 extending from the outer-surface located in a second-plane, wherein first-plane and the second-plane are parallel to one another and orthogonal to the longitudinal-axis 22 of the assembly 10.

Referring back to FIGS. 5A-5B, the first-pair of opposed arms 56 are disposed within the arc 50 defined by the pair of opposed arcuate flexible-beams 46, and the second-pair of opposed arms 58 are disposed outside the arc 50 defined by the pair of opposed arcuate flexible-beams 46, when the PLR 40 is in the pre-stage-position 42 (FIG. 5A). The second-pair of opposed arms 58 define a lead-angle 60 on edges of the second-pair of opposed arms 58 that are in contact with the pair of opposed arcuate flexible-beams 46. The lead-angle 60 is characterized by an angle between about 15-degrees and about 20-degrees (see FIGS. 6C and 6F), and enables the PLR 40 to maintain the pre-stage-position 42. As illustrated in FIG. 5B, the second-pair of opposed arms 58 are disposed within the arc 50 defined by the pair of opposed arcuate flexible-beams 46 when the PLR 40 is in the seated-position 44, whereby the pair of opposed arcuate flexible-beams 46 exert a retention-force 62 of at least 10 Newtons on the second-pair of opposed arms 58. The inventor has discovered that the retention-force 62 of at least 10 Newtons is sufficient to inhibit the PLR 40 from backing-out of the orifice 34 under typical vehicle operating conditions.

Referring again to FIGS. 6A-6F, the PLR 40 includes a sealing-ridge 64 projecting beyond a perimeter-surface 66. The sealing-ridge 64 is configured to forcibly engage a perimeter-wall 68 (see FIGS. 3-4) of the orifice 34 when the PLR 40 is moved from the pre-stage-position 42 to the seated-position 44. In the examples illustrated herein, the sealing-ridge 64 is formed integral to perimeter-surface 66. Other embodiments are envisioned, but not shown, where the sealing-ridge 64 is optionally an O-ring seal seated into a recess or groove formed into the perimeter-surface 66 of the PLR 40. The PLR 40 may have a single sealing-ridge 64, or may include a plurality of sealing-ridges 64 depending on a dimension of the orifice 34 and the sealing requirements of the application. As illustrated in FIG. 4, the plurality of sealing-ridges 64 are disposed within the orifice 34 when the PLR 40 is in the seated-position 44.

In the pre-stage-position 42 a portion of the perimeter-surface 66 extends into the orifice 34 (see FIG. 2) and the sealing-ridge 64 is characterized as having a radius in a range of 0.2 mm to 1.5 mm. When the PLR 40 is in the seated-position 44, as illustrated in FIG. 4, the sealing-ridge 64 is disposed within the orifice 34 and compressed to a height less than the radius, thereby sealing the orifice 34 to contaminants.

Figure 8:
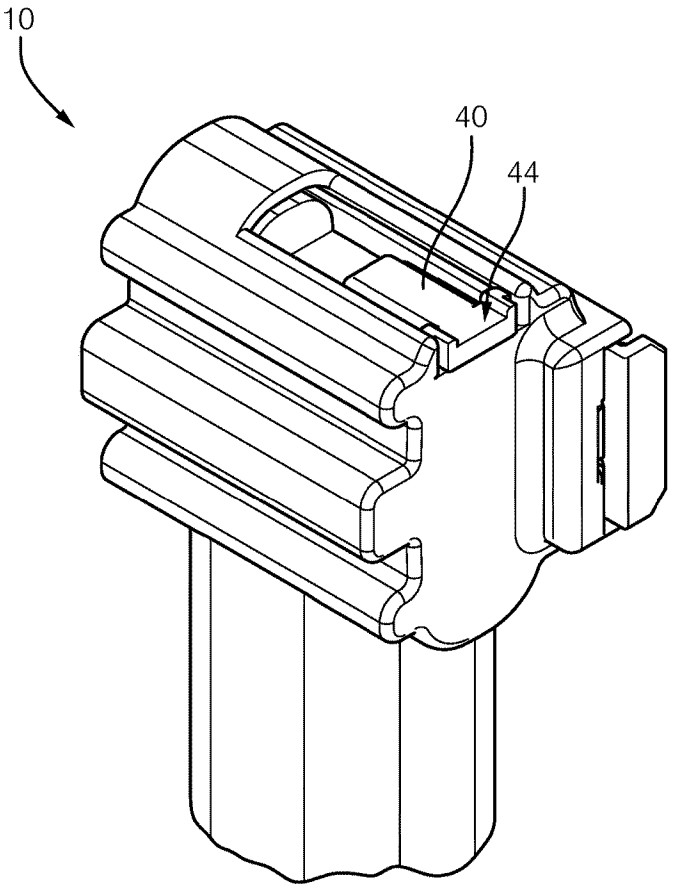
FIG. 8 is a perspective-view of the electrical connector assembly of FIG. 1 illustrating the primary-lock-reinforcement in a seated-position in accordance with one embodiment.
Figure 7:
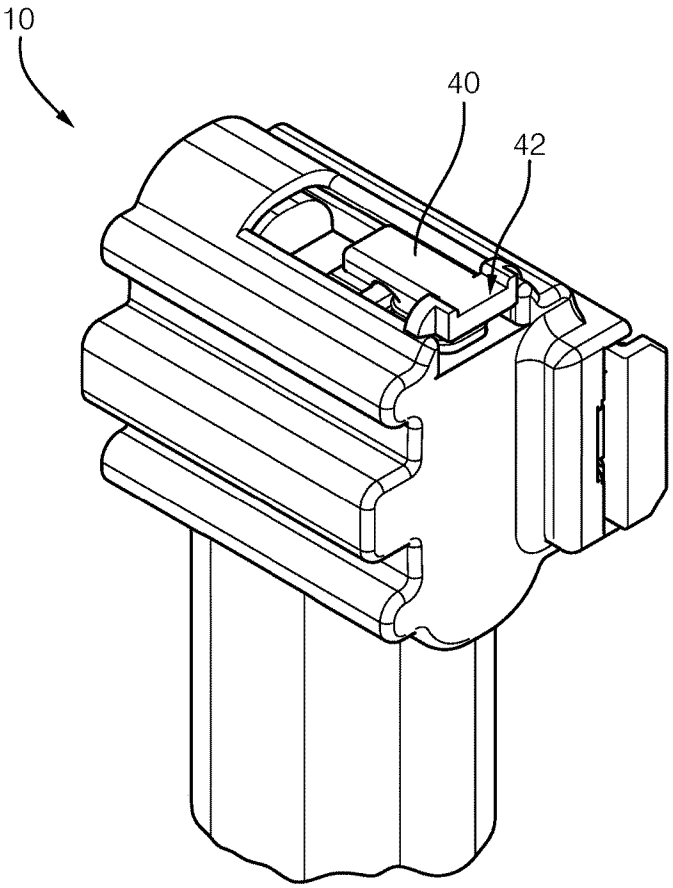
FIG. 7 is a perspective-view of the electrical connector assembly of FIG. 1 illustrating the primary-lock-reinforcement in a pre-stage-position in accordance with one embodiment.

FIG. 7 is a perspective-view of the assembly 10 illustrating the PLR 40 in the pre-stage-position 42, and FIG. 8 is a perspective-view of the assembly 10 illustrating the PLR 40 in the seated-position 44.

Figure 9:
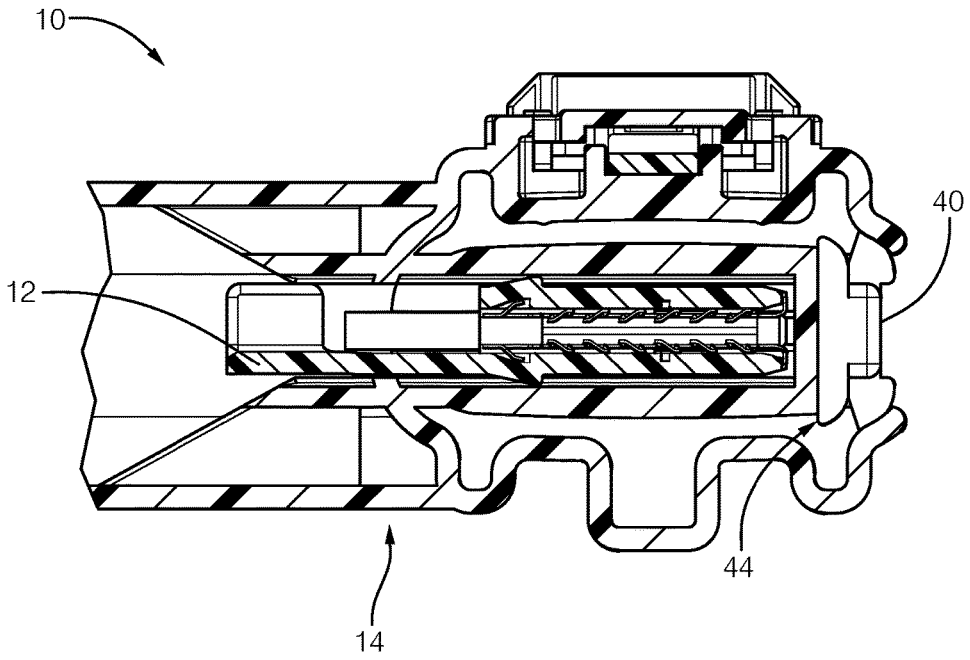
FIG. 9 is section-view of the electrical connector assembly of FIG. 1 illustrating the primary-lock-reinforcement in the seated-position in accordance with one embodiment.

FIG. 9 is section-view of the assembly 10 along the mating-axis 32 illustrating the PLR 40 in the seated-position 44 with the electrical-terminal 12 installed.

Accordingly, an electrical connector assembly 10 (the assembly 10), is provided. The assembly 10 is an improvement over prior art electrical connector assemblies because the assembly 10 may be formed using a single injection molding tool, and eliminates an inner-connector that would typically be required to retain the electrical-terminal 12 within the connector-housing 14. Additionally, the PLR 40 seals the assembly 10 to any contaminants.

While this invention has been described in terms of the preferred embodiments thereof, it is not intended to be so limited, but rather only to the extent set forth in the claims that follow. "One or more" includes a function being performed by one element, a function being performed by more than one element, e.g., in a distributed fashion, several functions being performed by one element, several functions being performed by several elements, or any combination of the above. It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact. The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

I claim:

1. An electrical connector assembly, comprising:

an electrical-terminal configured to receive a corresponding electrical-terminal;

a connector-housing defining a first-aperture, a second-aperture, and a body, said connector-housing configured to receive the electrical-terminal through the first-aperture along a longitudinal-axis of the connector-housing, said body defining a cavity having a cantilevered terminal-lock disposed within and attached to a base of the body, said cantilevered terminal-lock extending along the longitudinal-axis and terminating proximate an outer-wall of the body, said cantilevered terminal-lock configured to releasably retain the electrical-terminal such that the electrical-terminal is positioned to receive the corresponding electrical-terminal through the second-aperture along a mating-axis of the electrical-terminal, said outer-wall defining an orifice positioned proximate a terminus of the cantilevered terminal-lock; and a primary-lock-reinforcement configured to support the terminus of the cantilevered terminal-lock, wherein when the primary-lock-reinforcement is moved from a pre-stage-position to a seated-position the terminus is inhibited from deflecting away from the electrical-terminal along the mating-axis thereby sealing the orifice.

2. The electrical connector assembly in accordance with claim 1, wherein the mating-axis of the electrical-terminal is orthogonal to the longitudinal-axis, and wherein the outer-wall is adjacent both the first-aperture and the second-aperture and aligned parallel to the longitudinal-axis.

3. The electrical connector assembly in accordance with claim 1, wherein the mating-axis of the electrical-terminal is orthogonal to the longitudinal-axis, and wherein the outer-wall is opposite the first-aperture and adjacent the second-aperture and aligned orthogonal to the longitudinal-axis.

4. The electrical connector assembly in accordance with claim 3, wherein the connector-housing includes a pair of opposed arcuate flexible-beams that extend beyond the outer-wall along the longitudinal-axis, and wherein the primary-lock-reinforcement includes retention-features projecting from an outer-surface orthogonal to the longitudinal-axis, said retention-features configured to releasably retain the primary-lock-reinforcement between the pair of opposed arcuate flexible-beams in the pre-stage-position.

5. The electrical connector assembly in accordance with claim 4, wherein when the primary-lock-reinforcement is moved from the pre-stage-position to the seated-position the retention-features are disposed within an arc defined by the pair of opposed arcuate flexible-beams.

6. The electrical connector assembly in accordance with claim 5, wherein the retention-features are configured to produce a vibratory-response when the primary-lock-reinforcement is moved from the pre-stage-position to the seated-position.

7. The electrical connector assembly in accordance with claim 6, wherein the primary-lock-reinforcement is configured to provide an engagement-force of at least 10 Newtons to move the primary-lock-reinforcement from the pre-stage-position to the seated-position.

8. The electrical connector assembly in accordance with claim 5, wherein the retention-features define a first-pair of opposed arms extending from the outer-surface located in a first-plane, and further define a second-pair of opposed arms extending from the outer-surface located in a second-plane, said first-plane and said second-plane parallel to one another and orthogonal to the longitudinal-axis.

9. The electrical connector assembly in accordance with claim 8, wherein the first-pair of opposed arms are disposed within the arc defined by the pair of opposed arcuate flexible-beams, and wherein the second-pair of opposed arms are disposed outside the arc defined by the pair of opposed arcuate flexible-beams, when the primary-lock-reinforcement is in the pre-stage-position.

10. The electrical connector assembly in accordance with claim 9, wherein the second-pair of opposed arms define a lead-angle on edges of the second-pair of opposed arms, said edges in contact with the pair of opposed arcuate flexible-beams.

11. The electrical connector assembly in accordance with claim 10, wherein the lead-angle is characterized as by an angle between about 15-degrees and about 20-degrees.

12. The electrical connector assembly in accordance with claim 8, wherein the second-pair of opposed arms are disposed within the arc defined by the pair of opposed arcuate flexible-beams when the primary-lock-reinforcement is in the seated-position, whereby the pair of opposed arcuate flexible-beams exert a retention-force on the second-pair of opposed arms.

13. The electrical connector assembly in accordance with claim 12, wherein the retention-force is at least 10 Newtons.

14. The electrical connector assembly in accordance with claim 1, wherein the primary-lock-reinforcement includes a sealing-ridge projecting beyond a perimeter-surface, said sealing-ridge configured to forcibly engage a perimeter-wall of the orifice when the primary-lock-reinforcement is moved from the pre-stage-position to the seated-position.

15. The electrical connector assembly in accordance with claim 14, wherein the sealing-ridge is formed integral to the perimeter-surface.

16. The electrical connector assembly in accordance with claim 14, wherein the primary-lock-reinforcement includes a plurality of sealing-ridges.

17. The electrical connector assembly in accordance with claim 16, wherein the plurality of sealing-ridges are disposed within the orifice when the primary-lock-reinforcement is in the seated-position.

18. The electrical connector assembly in accordance with claim 14, wherein the sealing-ridge is characterized as having a radius in a range of 0.2 mm to 1.5 mm.

19. The electrical connector assembly in accordance with claim 18, wherein the sealing-ridge is compressed to a height less than the radius when the primary-lock-reinforcement is in the seated-position.

20. The electrical connector assembly in accordance with claim 14, wherein a portion of the perimeter-surface extends into the orifice when the primary-lock-reinforcement is in the pre-stage-position, and wherein the sealing-ridge is disposed within the orifice when the primary-lock-reinforcement is in the seated-position.

* * * * *